US005282764A

United States Patent [19]

Glen

[11] Patent Number: 5,282,764

[45] Date of Patent: Feb. 1, 1994

[54] OUTBOARD MOTOR AND BOAT

[75] Inventor: Robert D. Glen, Oxford, England

[73] Assignee: E. P. Barrus Limited, England

[21] Appl. No.: 729,749

[22] Filed: Jul. 12, 1991

[30] Foreign Application Priority Data

Jul. 12, 1990 [GB] United Kingdom ..... 9015321

[51] Int. Cl.[5] ..... B63H 21/24

[52] U.S. Cl. ..... 440/88; 440/77; 440/900; 123/195 P

[58] Field of Search ..... 440/49, 53, 76, 77, 440/88, 89, 900; 123/195 P, 195 C, 468, 469, 698

[56] References Cited

U.S. PATENT DOCUMENTS

| | | | |
|---|---|---|---|
| 3,552,121 | 1/1971 | Kitagawa et al. | 440/89 |
| 4,375,356 | 3/1983 | Stevens | 440/900 |
| 4,758,190 | 7/1988 | Van Vuren | 440/900 |
| 4,846,300 | 7/1989 | Boda | 440/900 |
| 5,052,961 | 10/1991 | Uchida et al. | 440/900 |

OTHER PUBLICATIONS

Four Wheeler, Nov. 1989, vol. 26, No. 11, Canoga Park, Calif.

*Primary Examiner*—David M. Mitchell
*Assistant Examiner*—Stephen P. Avila
*Attorney, Agent, or Firm*—Andrus, Sceales, Starke & Sawall

[57] ABSTRACT

The present invention comprises an outboard motor (1) having a number of special features which prevent the ingress of water so that it can be operated underwater and a boat (10) also having a number of special features to be used together with the outboard motor (1). The features on the outboard motor (1) include a device for creating a water-tight seal on the carburetor shaft mountings (24, 26); a device for protecting the air intake of the carburetor against ingress of water (8, 9, 11, 13; 9, 14, 15); a bellows (28) coupled to and encapsulating the starter motor (5); a sealed housing (32) for the electrical system having a moisture-tight seal around each wire at the junction with the sealed housing; a one-way valve (22) disposed in the exhaust (6); and means for protecting the atmospheric vents (20, 21) against ingress of water. The features on the boat (10) include such an outboard motor (1) plus a ducted air intake (11, 15) for the carburetor (2) passing through an air sump (9).

20 Claims, 3 Drawing Sheets

OUTBOARD MOTOR AND BOAT

The present invention relates to a boat having an outboard motor, and in particular, to an outboard motor designed to minimise the ingress of water when the motor is submerged, thereby enabling the motor to continue to operate under water.

Outboard motors are often used with a rigid inflatable boat. In high sea conditions, the boat may be capsized or the motor may become submerged. More boats become incapacitated through the motor becoming submerged than the boat capsizing.

When a motor is submerged, water may enter through the exhaust, the air intake for the carburetor; the injection system; the atmospheric vents on the carburetor and exhaust; the choke or throttle spindle shaft and through to the starter motor and to the electrical circuits. Ingress of water via any of these routes will incapacitate the motor. It is necessary, in order to restart the motor, to drain water from the motor, expunge decontaminated fuel from the carburetors, and fit dry spark plugs.

In high seas, or other adverse weather conditions, it is rarely possible to effectively drain the motor and fit dry spark plugs. Consequently, the boat must then be abandoned or towed to safety.

Accordingly, many attempts have been made to seal the motor to prevent the cause of incapacitation.

Initially, external covers with seals were provided for the motor. These are effective until the first maintenance or repair is executed on the motor, since the seals have to be broken to provide access to the motor. Subsequent re-sealing is never as effective.

Known preventive measures have also included an elongated air intake installation for the carburetor to the cover of the motor. Again, once the seals of the cover are broken, then such elongated air intake installations become ineffective. Another known measure comprises an elongated air intake installation located in the boat, so that its open end is disposed in a hood or cabin. Such installations though are not capable of effectively protecting the carburetor/injection system when the boat capsizes and furthermore does not provide effective protection when water penetrates the motor cover.

All of the measures known to date do not effectively protect a motor in adverse conditions..

An aim of the present invention is therefore to provide a motor having a number of features which improve the chances of it running under water.

Another aim of the present invention is to provide a boat having such a motor.

According to the present invention there is provided an outboard motor comprising at least one carburetor having an air intake, at least one starter motor, an exhaust and a number of atmospheric vents characterized by the combination of:

means for creating a water-tight seal on the or each carburetor shaft mountings;

means for protecting the air intake of the or each carburetor against ingress of water;

means for protecting the or each starter motor;

a sealed housing for the electrical system having a moisture-tight seal around the or each wire at the junction with the sealed housing;

a one-way valve disposed in the exhaust; and means for protecting the atmospheric vents against ingress of water.

Also according to the present invention there is also provided a boat having such an outboard motor.

Embodiments of the present invention will now be described with reference to the accompanying drawings, in which.

Figure 2:
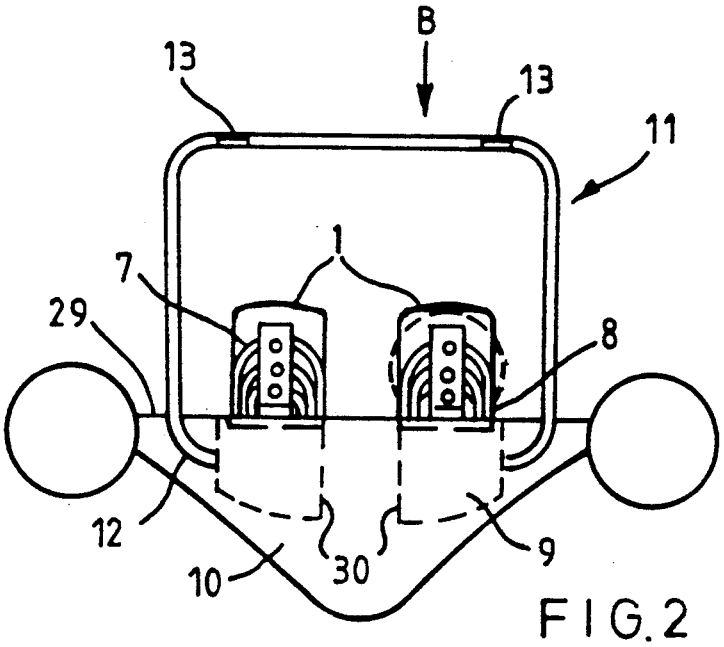
FIG. 2 is a schematic cross-section of a rigid inflatable boat, having an air intake installation according to the preferred embodiment.
Figure 3A:
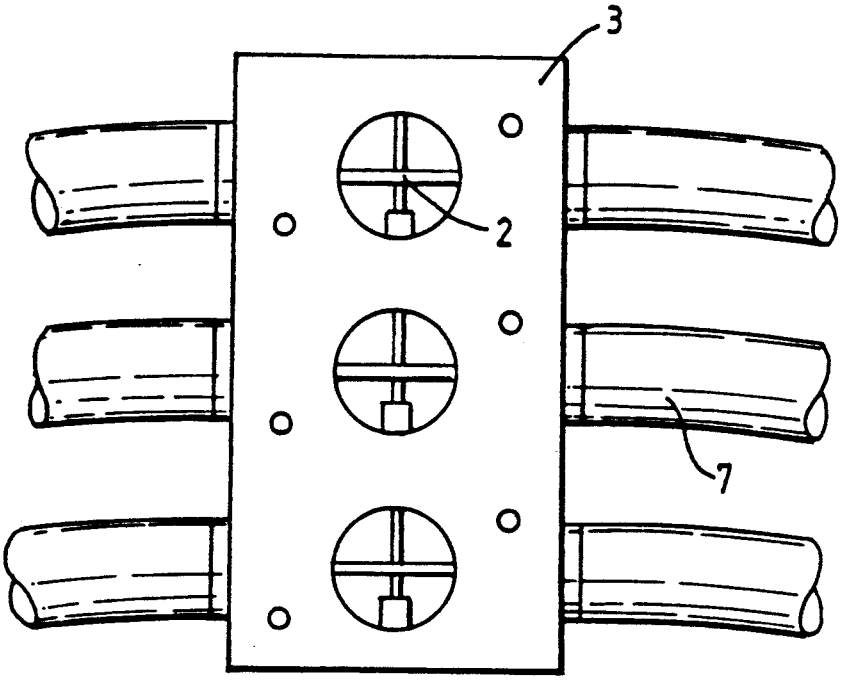
Figure 3B:
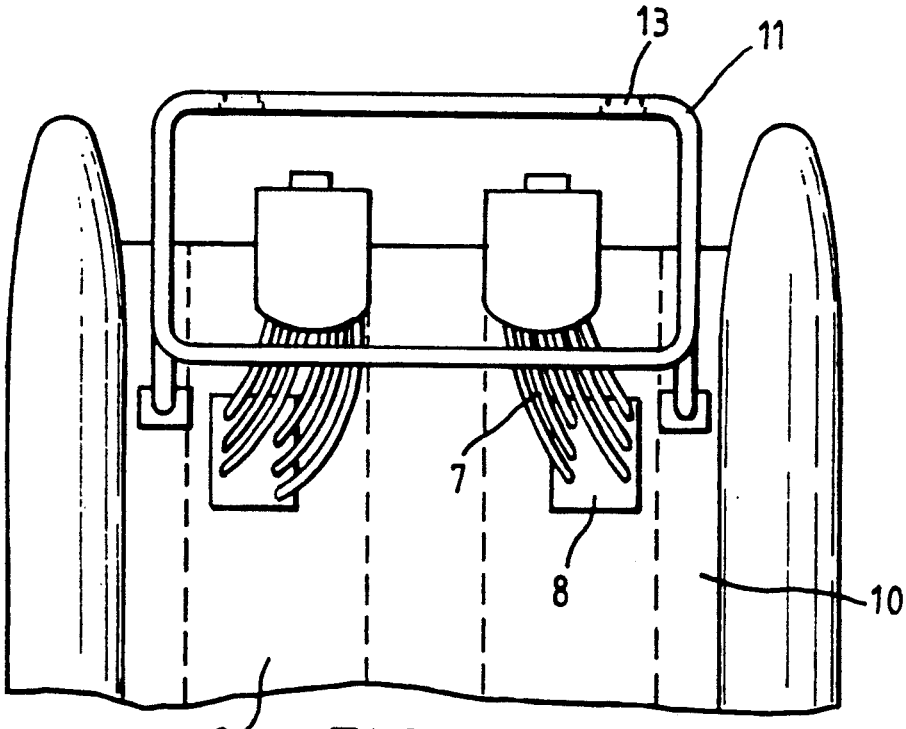
Figure 4:
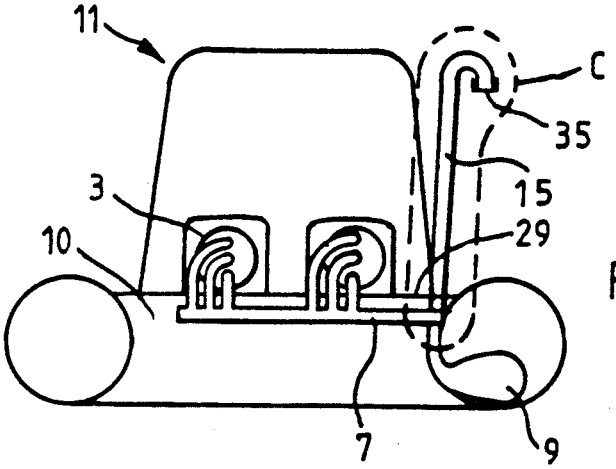
Figure 5A:
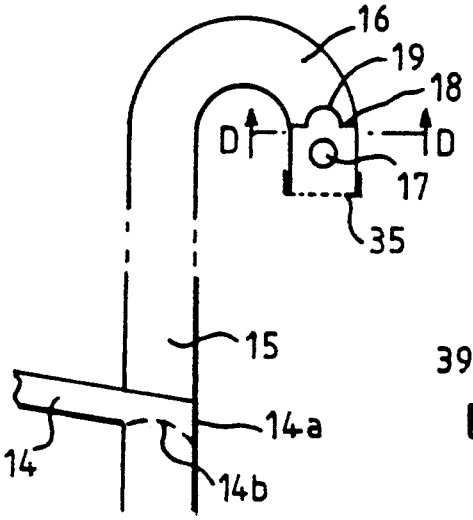
Figure 5B:
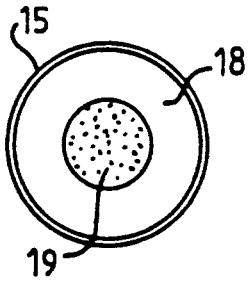

FIG. 3*a* is an enlargement of PART A in FIG. 2;

FIG. 3*b* is a view in the direction of ARROW B in FIG. 2;

FIG. 4 is a schematic cross-section of a rigid inflatable boat having an air intake installation according to a second embodiment;

FIG. 5*a* is an enlargement of part C FIG. 4;

FIG. 5*b* is a cross-section along the line D—D in FIG. 5*a;*

Figure 6:
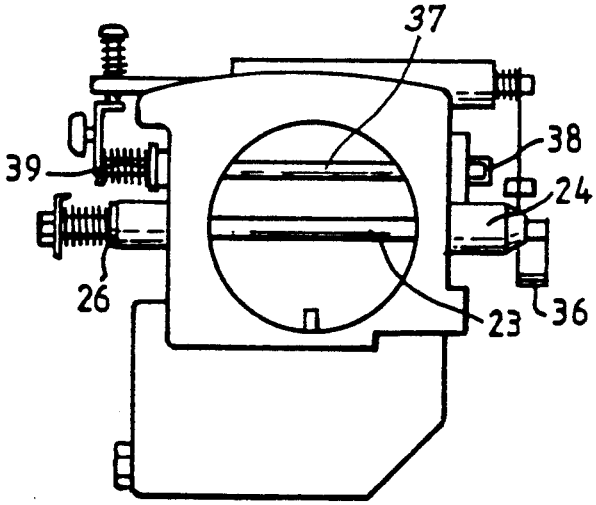
Figure 7:
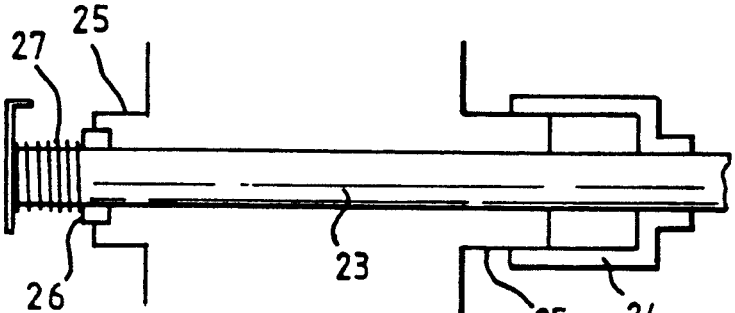

FIG. 6 is a schematic partial cross-section of a carburetor according to the preferred embodiment;

FIG. 7 is an enlargement and partial cross-section along the line E—E in FIG. 6.

Figure 1:
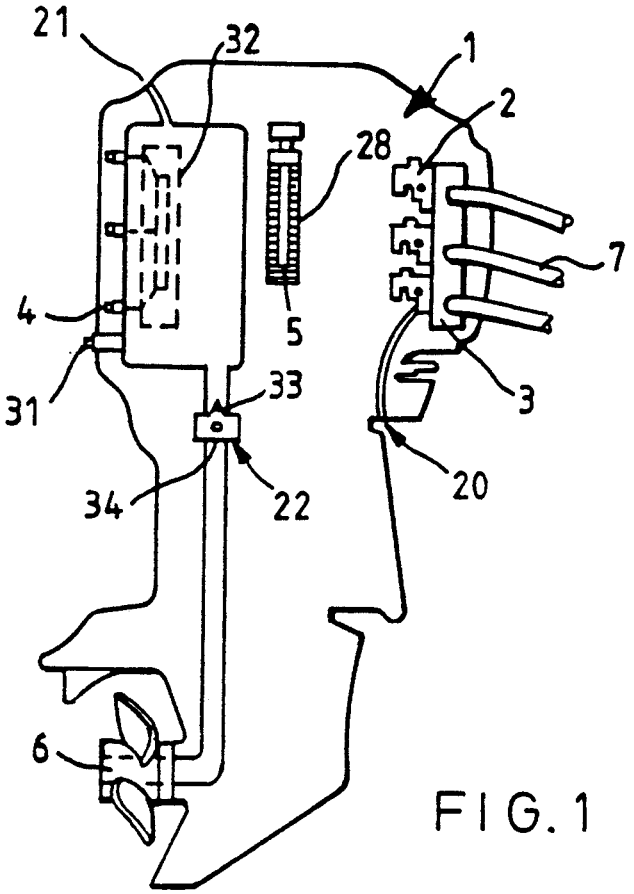
FIG. 1 is a partial schematic cross-section of an outboard motor, highlighting features of a preferred embodiment.

As shown schematically in FIG. 1, the present invention relates to a number of novel features which improve the chances of an outboard motor 1 operating even if submerged.

The motor 1 includes the usual features such as carburetors 2 coupled to a manifold 3; pistons (not shown); spark plugs 4; connecting rods (not shown); starter motor 5; and through propellor exhaust 6.

In the preferred embodiment, there are three carburetors 2, the air intake of each is coupled to a common manifold 3. Referring to FIGS. 2, 3*a* and 3*b* as well in which two motors 1 are shown, each manifold 3 has a number of tubes 7 extending therefrom and facing downwardly to a respective common termination point 8.

The length of the tubes 7 is chosen so as to allow the motor to turn yet not be so long as to be an obstruction. The common termination point 8 comprises a plate having unions machine turned therein to allow each of the tubes 7 to be screwed into a respective union.

An air sump 9 for each motor 1 is located under the deck 29 of the boat 10 and each comprises an integral chamber in the hull design. Each of the tubes 7 communicates with the air sump 9 via the common termination point 8.

The air sump 9 is located beneath the deck 29 of the boat so as to minimise any obstruction on the deck of the boat 10, which is particularly important in adverse weather conditions and at night. Preferably also, the tubes 7 are fabricated from known reinforced flexible pipes. Crushed pipes can result in either starving the carburetors of air or creating a crack in the pipe leading to leaks in the air installation system. Consequently the pipes are reinforced. However, the pipes need to be flexible to allow the motor 1 to be fitted and turned as desired. Accordingly the pipes are reinforced yet flexible, In order to provide air to the carburetors 2 the air sump 9 needs to be open to the atmosphere yet protected to prevent water ingress. As shown in FIG. 2, the air sump 9 terminates to the atmosphere via a hollow roll frame 11 through a tube 12. Inlet vents 13 are provided in the top of the roll frame 11 to provide the through flow of air.

If the boat 10 capsizes or water splashes onto the roll frame 11, then any such water runs down the inside of the roll frame 11 and into the bottom of the air sump 9 but it is not drawn into the engine as the air sump is so large compared to the suction pressure of the engine.

Each air sump 9 is provided with a sealable port 30, such as a screwed plug thereby enabling excess water to be drained off as and when necessary. The inlet vents 13 may be provided with a valve but this is usually not necessary as this air intake protection system is already quite adequate.

The second embodiment is shown in FIGS. 4, 5*a* and 5*b*, and incorporates a ducting 14 which traverses the boat 10 underneath the deck 29 substantially horizontally and terminates in a vertical air inlet tube 15. The end 14*a* of the ducting 14 is maintained watertight with the walls of the inlet tube 15 as shown. An opening 14*b* is disposed in the ducting 14 and faces downwards away from the end of the air inlet tube 15. Consequently, if the boat 10 capsizes or water splashes into the air inlet tube 15, then any such water runs past the ducting 14 and into the air sump 9 and very little, if any, penetrates the ducting 14 through the opening 14*b*.

In this second embodiment, the inlet pipe 15 is also provided with a U-turn 16 and a gravity ball valve 17. The U-turn 16 is provided with a seat 18 having air holes 19 disposed in the hemispherical part of the seat 18 but not in the surrounds. A grill cap 35 is provided to prevent the ball of the ball valve from escaping.

When the boat 10 capsizes, the ball 17 sits in the hemispherical seat, blocking the air holes 19 thereby preventing water from penetrating the air ducting system. In the upright position, the ball 17 is retained by the grill cap 35 but does not therefore interfere with the air intake to the carburettors.

Although this embodiment employs a U-turn 16 and ball valve 17 most types of one-way valve may be used, including reed valves or flap valves etc.

Further measures designed to minimise the ingress of water to the motor are illustrated with reference to FIG. 1 again.

A motor requires a number of air passages in order to operate and such must also be sealed or protected. For example, the atmospheric vent 20 on the carburettor or the exhaust atmospheric vent 21. In the preferred embodiment, these vents 20, 21 are also provided with a protection system (not shown) comprising ducting into a respective snorkel pipe with one way valves at the open end and a grill cap. These protection systems are merely a smaller version of that provided in the inlet tube 15. In each case the snorkel of the protection systems may stand proud of the engine cowl or terminate within the engine cowl.

Another passage requiring protection is the exhaust 6. However, whilst the motor is running the pressure of the exhaust gases prevents any water from rising into the engine part of the motor. If, the motor stops for any reason, or the engine is just idling, then the back pressure created in the engine may be sufficient to siphon water into the engine. Accordingly, the exhaust 6 is also provided with a one-way valve system 22. The one-way valve 22 comprises a ball valve 33 disposed behind a grill 34 to ensure the ball of the ball valve is not lost.

With all these measures which are provided on the air passages for allowing gases into and out of the engine, water can be prevented from reaching the engine. Consequently, measures to keep the spark plugs dry are not necessary as water should not be sucked in by the engine reaching the spark plugs by virtue of the aforementioned features. If, however, water does trickle to the engine, further measures are disclosed.

FIG. 6 is a schematic cross-section of the carburetor 2. The carburetor 2 itself can be sealed relatively easily to prevent water seepage except the carburetor shaft 23. Accordingly, the preferred embodiment of the present invention includes means creating a water-tight seal on the shaft mountings.

This water-tight seal means includes a compressed rubber cap 24 between the carburetor housing 25 and the throttle lever 36 and is fixed to the carburetor housing 25 yet permits the shaft 23 to rotate therein. At the other end of the shaft 23, there is provided an O-ring compression seal 26, preferably a neoprine seal, between the carburetor housing 25 and the spring 27 on the shaft 23. The seal 26 is fixed with respect to the shaft 23 and does not rotate with the shaft 23.

These measures enable the carburetor shaft to rotate in the carburetor yet provides a water-tight seal over 78–80 degrees of rotational movement.

Similar measures are also provided on the choke spindle 37 of the choke 31. Thus a compressed cap 36 and an O-ring compression seal 39 are arranged as on the carburetor shaft In the preferred embodiment, the electrical parts eg. switches of the engine are also disposed in a sealed housing 32. All of the wires going into or out of the sealed housing are sealed at the junction. This may be achieved by rubber bushings which is a known moisture protection measure. However, more preferably an hydrophobic moulding compound is used when maleable to be shaped around the wire junction and it it then cured to form a moisture tight seal. Hydrophobic compounds include acrylic resins.

The starter motor 5 can not be sealed with the rest of the electrical parts. Accordingly, the preferred embodiment of the present invention includes means for protecting the starter motor.

When the starter motor runs, the air inside heats up and expands. If, the outboard motor is submerged in water, the gas temperature is lowered and the degree of expansion is reduced. In Order to accommodate for this change in volume the preferred embodiment of the present invention includes a bellows type structure 28. The bellows 28 expand and contract as and when necessary and also the expansion and contraction varies in accordance with the temperature surrounding the starter motor. The bellows 28 are attached to the top cover of the starter motor completely encapsulating it.

This aspect of the present invention is also applicable to any type of engine not just one disposed in an outboard motor.

The combination of all these measures thus enables the motor to operate even if submerged. The advantages of such a motor can readily be appreciated in adverse sea conditions.

The foregoing description has been given by way of example only and it will be appreciated by a person skilled in the art that modifications may be made without departing from the scope of the invention. For example, the manifold 3 may not be used, with the tubes 7 coming directly from each carburetor air intake.

I claim:

1. An outboard motor (1) comprising at least one carburetor (2) having a housing (25), an air intake (7) therethrough, a shaft (23) extending through the housing with respective opposite ends of the shaft carrying a throttle lever (36) rocker arm and a shaft spring (27), at least one starter motor (5), an electrical system, an exhaust (6) and a number of atmospheric vents (20,21) characterized by the combination of:

means including a compression cap (24) disposed on said shaft between the carburetor housing and the throttle lever rocker arm and fixed in response to said housing and an O-ring compression seal (26) disposed on said shaft between the carburetor housing and the shaft spring and fixed with respect to said shaft for creating a water-tight seal on the carburetor shaft mounting;

means (8,9,11,13; 9,14,15) for protecting the air intake (7) of the carburetor (2) against ingress of water;

means for protecting the starter motor (5);

a sealed housing (32) for the electrical system including at least one wire entering the housing and having a moisture-tight seal around the wire at the junction with the sealed housing;

a one-way valve (22) disposed in the exhaust (6); and means for protecting the atmospheric vents (20,21) against ingress of water.

2. An outboard motor (1) as claimed in claim 1, in which said compression cap (24) is formed of rubber and said O-ring compression seal (26) is formed of neoprine.

3. An outboard motor as claimed in one of claim 1 or 2, in which said moisture-tight seal around the wire comprises an hydrophobic compound formed around the wire at the junction with the sealed housing.

4. An outboard motor as claimed in one of claim 1 or 2, in which said one-way exhaust valve (22) comprises a ball valve (33).

5. An outboard motor as claimed in one of claims 1 or 2, in which said atmospheric vent protection means includes a snorkel with a one-way valve arranged at the open end of the snorkel.

6. An outboard motor as claimed in one of claims 1 or 2, further comprising at least one tube (7) communicating with the air intake of the carburetor (2).

7. An outboard motor as claimed in claim 6, in which each carburetor is coupled to a manifold (3) and each tube (7) is connected to said manifold.

8. An outboard motor as claimed in one of claims 1 or 2, further comprising a choke (31) having a housing and a choke spindle (37) mounted therein and means for creating a water-tight seal on the choke spindle mountings.

9. An outboard motor as claimed in claim 8, in which said water-tight seal means comprises a compression cap (24) disposed on said spindle between the choke housing and the choke lever and an O-ring compression seal disposed on said shaft between the choke housing and the shaft spring.

10. An outboard motor as claimed in one of claim 1 or 2, in which said starter motor includes a top plate, and wherein said means (28) for protecting the starter motor (5) comprises a bellows structure (28) attached to the top plate of the starter motor (5) encapsulating the starter motor (5).

11. A boat having an outboard motor as claimed in one of claims 1 or 2.

12. A boat as claimed in claim 11 including at least one tube (7) communicating with the air intake of the carburetor (2) and wherein said carburetor air intake protection means includes an air sump (9) communicating with the tube (7) and the atmosphere.

13. A boat as claimed in claim 12, in which said air intake protection means further includes first ducting (11, 15) through which the air sump (9) communicates with the atmosphere.

14. A boat as claimed in claim 13, further comprising a hollow roll frame having at least one vent (13), a tube (12) connecting said vent to said air sump (9), thereby defining said first ducting (11).

15. A boat as claimed in claim 13, in which said first ducting (15) extends vertically and includes a snorkel (16) with a one-way valve (17) arranged at the open end of the snorkel.

16. A boat as claimed in claim 15, further comprising a further ducting (14) into which the tube (7) terminates and which is coupled to said first ducting (15).

17. A boat as claimed in claim 16, in which one end (14*a*) of said further ducting (14) forms a seal with the inside wall of the first ducting (15) and an opening (14*b*) is formed in the further ducting (14) and is arranged facing away from the snorkel (16).

18. A boat as claimed in claim 12, said boat including a deck, in which said air sump (9) is disposed beneath the deck (29) of the boat (10).

19. A boat as claimed in claim 16, said boat including a deck, in which said further ducting (14) is disposed beneath the deck (29) of the boat (10).

20. A carburetor (2) having a housing (25) and a carburetor shaft (23) terminating at one end with a shaft spring and at the other end with a throttle lever (36) comprising a compression cap (24) disposed on said shaft (23) between the carburetor housing (25) and the throttle lever (36) and fixed with respect to said housing (25) and an O-ring compression seal (26) disposed on said shaft between said carburetor housing (25) and the shaft spring (27) and fixed with respect to said shaft (23).

* * * * *